US007754672B2

(12) United States Patent
Beenen et al.

(10) Patent No.: US 7,754,672 B2
(45) Date of Patent: Jul. 13, 2010

(54) POLYMER BOUND MANGANESE COMPOUNDS IN CLEANING COMPOSITION

(75) Inventors: Henk Beenen, Zwolle (NL); Robbert de Boer, Oene (NL); Inge Stroeks, Hardewijk (NL); Janco Van Ommen, Zwolle (NL); Elke Philippsen-Neu, Cologne (DE); Gaye Ayan, Aachen (DE); Jürgen Krichel, Julich (DE)

(73) Assignee: Dalli-Werke GmbH & Co. KG, Stolberg (DE)

( * ) Notice: Subject to any disclaimer, the term of this patent is extended or adjusted under 35 U.S.C. 154(b) by 598 days.

(21) Appl. No.: 10/591,375

(22) PCT Filed: Feb. 22, 2005

(86) PCT No.: PCT/EP2005/001813

§ 371 (c)(1),
(2), (4) Date: Jul. 19, 2007

(87) PCT Pub. No.: WO2005/095570

PCT Pub. Date: Oct. 13, 2005

(65) Prior Publication Data

US 2008/0004196 A1 Jan. 3, 2008

(30) Foreign Application Priority Data

Mar. 2, 2004 (EP) ..... 04004769

(51) Int. Cl.
*C11D 3/02* (2006.01)
*C11D 3/39* (2006.01)
*C11D 17/00* (2006.01)

(52) U.S. Cl. ..... 510/401; 510/220; 510/224; 510/440; 510/375; 510/221; 510/530; 510/445; 510/226; 510/447; 510/392; 510/367; 510/374; 510/376

(58) Field of Classification Search ..... 510/400, 510/224, 375, 221, 220, 530, 445, 311, 226, 510/368, 236, 447, 392, 367, 374, 376, 401
See application file for complete search history.

(56) References Cited

U.S. PATENT DOCUMENTS 3,969,540 A * 7/1976 Jensen ..... 426/657
4,539,132 A * 9/1985 Oakes ..... 510/306

(Continued)

FOREIGN PATENT DOCUMENTS

DE 43 15 397 A1 11/1994

(Continued)

OTHER PUBLICATIONS

Derwent abstracts of WO 03/104367 published Dec. 2003, Hardacker et al.*

*Primary Examiner*—Mark Eashoo
*Assistant Examiner*—Jane L Stanley
(74) *Attorney, Agent, or Firm*—Knobbe Martens Olson & Bear LLP

(57) ABSTRACT

The present invention relates to cleaning compositions comprising polymer bound manganese compounds as reducing agents and the use of such manganese compounds in cleaning compositions, particularly to machine dishwashing compositions comprising a protein bound manganese compound as a silver corrosion protection agent and the use of such a manganese compound in dishwashing compositions.

6 Claims, 3 Drawing Sheets

| detergent | A | B | C | new spoon |
|---|---|---|---|---|
| discoloration score | 2 | 3 | 5 | |

U.S. PATENT DOCUMENTS

| | | | | | |
|---|---|---|---|---|---|
| 4,731,196 | A | * | 3/1988 | Staton et al. | 252/184 |
| 5,240,633 | A | * | 8/1993 | Ahmed et al. | 510/221 |
| 5,246,612 | A | * | 9/1993 | Van Dijk et al. | 510/226 |
| 5,275,943 | A | * | 1/1994 | DiTuro | 435/179 |
| 5,358,722 | A | | 10/1994 | Monzyk | |
| 5,681,554 | A | * | 10/1997 | Cannell et al. | 424/70.14 |
| 5,968,881 | A | * | 10/1999 | Haeggberg et al. | 510/226 |
| 7,375,243 | B2 | * | 5/2008 | Park et al. | 556/50 |
| 2002/0182237 | A1 | * | 12/2002 | Bissett et al. | 424/401 |
| 2002/0182745 | A1 | * | 12/2002 | Anderson et al. | 436/177 |
| 2003/0158111 | A1 | * | 8/2003 | Bar-Or | 514/12 |

FOREIGN PATENT DOCUMENTS

| | | | | |
|---|---|---|---|---|
| WO | WO 95/20030 | | | 7/1995 |
| WO | WO 95/20030 | A1 | | 7/1995 |
| WO | WO 96/41860 | | | 12/1996 |
| WO | WO 96/41860 | A1 | | 12/1996 |
| WO | WO 03/104367 | | * | 12/2003 |
| WO | WO 03/104368 | A1 | | 12/2003 |

* cited by examiner

| | | | | |
|---|---|---|---|---|
| detergent | A | B | C | new spoon |
| discoloration score | 2 | 3 | 5 | |

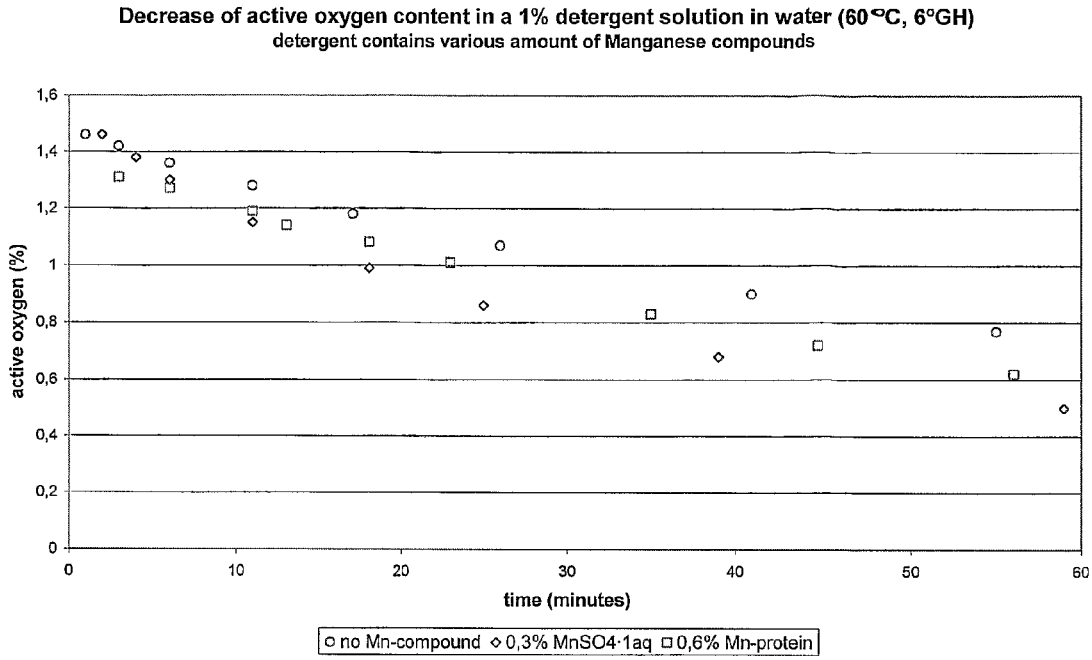
figure 3.1-1
figure 3.1-2
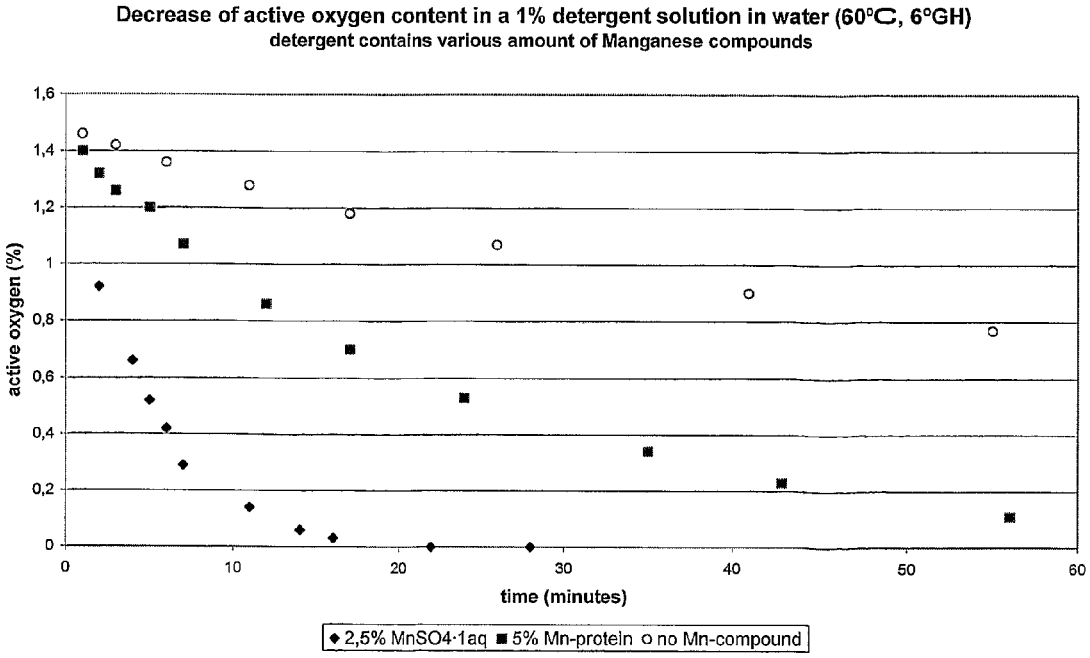

POLYMER BOUND MANGANESE COMPOUNDS IN CLEANING COMPOSITION

RELATED APPLICATIONS

This application is a U.S. National Phase of International application No.: PCT/EP2005/001813, filed Feb. 22, 2005, designating the U.S. and published in English on Oct. 13, 2005 as WO 2005/095570, which claims the benefit of European application No.: 04004769.8, filed Mar. 2, 2004.

FIELD OF THE INVENTION

This invention relates to cleaning compositions comprising polymer bound manganese compounds as reducing agents and the use of such manganese compounds in cleaning compositions, particularly to machine dishwashing compositions comprising a protein bound manganese compound as a silver corrosion protection agent and the use of such a manganese compound in dishwashing compositions.

BACKGROUND OF THE INVENTION

It is generally well-known that silver surfaces even when not in use get tarnished in course of time due to corrosive reactions. The same phenomenon can be observed when silverware is washed in machine dishwashers. This is due to several chemical reactions which can occur when the silver gets into contact with sulfur, oxygen and chlorine containing compounds under the high temperature and alkalinity conditions in a machine dishwasher. The sulfur containing compounds result from food residues, e.g. egg yolk, which are solved in the dishwashing water. The oxygen containing compounds reactive with the silver surfaces, e.g. peracetic acid, can be formed when bleach activators are used in the dishwasher cleaning composition. A high amount of salt in dishwashing water can result in chlorine containing plaques on the silver surfaces.

Several silver corrosion protection agents have been described in the patent literature. The British patent GB 1131738 discloses dishwashing agents which use benzotriazoles as a corrosion inhibitor for silver. Benzotriazoles in the context of silver corrosion protection are also disclosed in the U.S. Pat. No. 2,549,539 and the European patents EP 135 226 and EP 135 227.

Another group of compounds used as silver corrosion protection agents comprises manganese salts or manganese complex compounds. The German laid open patent number DE 4315397 discloses organic and anorganic redox compounds containing manganese(II) compounds, e.g. manganese(II) sulfate, manganese(II)acetoacetate and manganese(II)acetylacetonate. These low valent manganese compounds have to be coated prior to their use in cleaning compositions containing bleaching agents in order to avoid their oxidation or decomposition during storage.

SUMMARY OF THE INVENTION

It is an object of the present invention to provide an agent imparting good silver corrosion protection properties to cleaning compositions, preferably of dishwashing cleaning composition, whereby the agent can be used without being modified, e.g. being coated with a waterproof coating layer, prior to its use in cleaning compositions.

This object can be achieved by the present invention, i.e. by the independent and dependent claims, which will be described in detail in the following.

In its broadest aspect the invention concerns the use of manganese or manganese compounds as reducing agents in cleaning compositions whereby the manganese (compound) is bound to at least one polymer (compound) or is surrounded by, associated with or contained within at least one polymer (compound).

In a further aspect the invention provides a cleaning composition containing a manganese compound as a reducing agent whereby said manganese is bound to at least one polymer (compound) or is surrounded by, associated with or contained within at least one polymer (compound).

BRIEF DESCRIPTION OF THE DRAWINGS

FIG. 3 shows the test results of Example 1, test 3 (bleaching performance). The results of the lower concentrations (0.3% $MnSO_4 \times 1$ aq., 0.6% manganese proteinate) of application are shown in FIG. 3.1-1 and the higher concentrations (2.5 $MnSO_4 \times 1$ aq., 5% manganese proteinate) of application are shown in FIG. 3.1-2.

DETAILED DESCRIPTION OF THE PREFERRED EMBODIMENT

Figure 1:
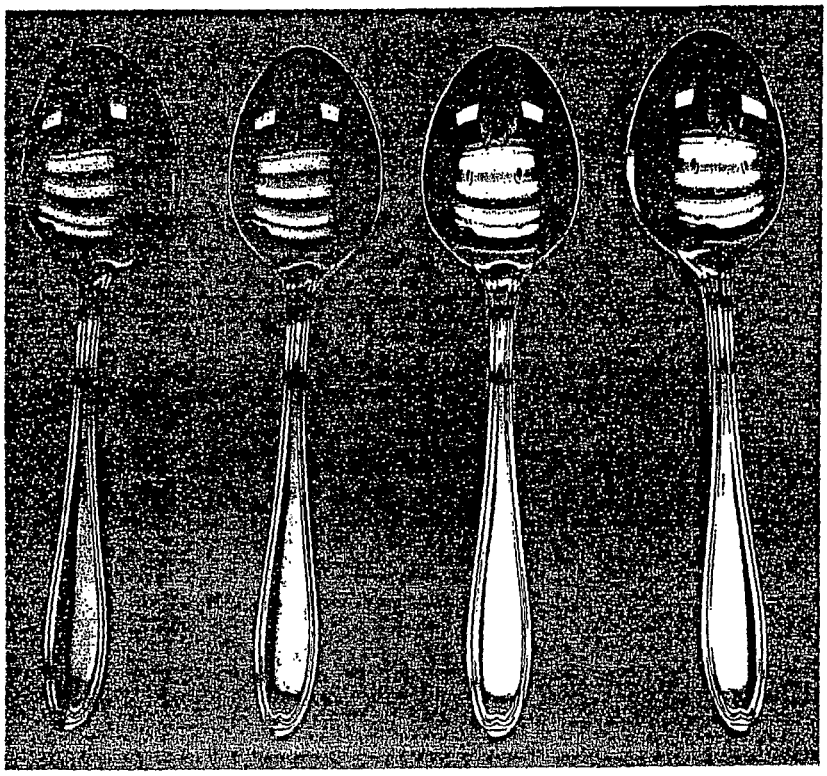
FIG. 1 shows the test results of Example 1, test 1 (silver protection).

It has surprisingly been found that dishwashing cleaning compositions containing low valent manganese (compound(s)) associated with polymers, preferably a manganese proteinate, exhibit excellent silver corrosion protection properties.

With "corrosion" is meant any visible change of a metal surface, preferably of a silver surface. For example, the visible change of a silver surface can result from chemical reactions of the silver with sulfur, oxygen or chlorine containing compounds under the conditions in a machine dishwasher.

The polymer usable according to the present invention is any polymer capable to bind, surround or associate small compounds like for example manganese compounds, preferably the polymer is a protein or a fragment thereof, whereby the term "protein" means any type of proteins like for example protein clusters with several subunits, proteins with a single amino acid sequence chain and protein fragments or peptides. It might be, but is not necessary that the protein has any catalytic activity. The protein can comprise any three dimensional structure or can be a random coil.

With "proteinate" is meant any protein cluster, protein(s), protein fragment(s) or peptide(s) containing at least one metal ion or atom or a metal compound, preferably a manganese ion, atom or compound, whereby said ion, atom or compound is bound to or associated with or surrounded by or contained within said protein or protein fragment.

In preferred embodiments of both above aspects of the invention, the manganese or manganese compound is bound to at least one protein or protein fragment or peptide or is surrounded by, associated with or contained within at least one protein, protein fragment or peptide.

Preferably at least one manganese ion, atom or compound is bound, associated with, contained in or surrounded by the protein. More preferred at least two, particularly preferred at least four manganese ions, atoms or compounds are contained. Preferred manganese compounds are manganese(II) salts.

In a particularly preferred embodiment the manganese containing polymer is provided in a form of a "manganese proteinate", wherein preferably a manganese sulfate, particularly preferred a manganese(II)sulfate monohydrate is bound to, associated with or surrounded by a protein. A particularly preferred Mn-proteinate is a product called PROTEINATO DI MANGANESE, available from SICIT 2000 S.p.A., Chiampo, Italy. Such manganese proteinates up to now are known as ingredients in animal food, particularly in food for cattle.

Further suitable polymers for binding, surrounding, containing or associating the manganese (compound) are herein later described as dispersant polymers.

In a preferred embodiment of the invention the cleaning composition is a automatic dishwashing cleaning composition (ADCC) in the form of a tablet, a granulate or a powder.

In a preferred embodiment of the tabletted cleaning composition the composition additionally contains a bleaching agent whereby the manganese compound and the bleaching agent are provided in separate layers of the tablet.

In another embodiment the cleaning composition is in form of granulates, wherein the manganese proteinate and a bleaching agent are mixed to give a cleaning composition, however, the manganese compound and the bleaching agent have no direct contact.

The cleaning composition preferably is a dishwashing cleaning composition, comprising further ingredients such dishwashing compositions usually contain, e.g. selected from but not limited to the following ingredients.

Additionally to the manganese compound in association with the polymer further usual transition metal bleach catalysts can be contained in the composition. Transition metal bleach catalysts can range from supported or unsupported transition metal salts, including but not limited to those of iron, manganese, copper, cobalt and ruthenium; see for example U.S. Pat. No. 3,398,096 simple water-soluble salts of iron and manganese such as the divalent, trivalent, tetravalent and quadrivalent salts; to more sophisticated catalysts such as those of the following references:

One group of usually used catalysts are those comprising manganese. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and EP-A 549 271, EP-A 549 272, EP-A 544 440, and EP-A 544 490. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

Iron or Manganese salts of aminocarboxylic acids in general are used; these include iron and manganese aminocarboxylate salts disclosed for bleaching in the photographic color-processing arts. A particularly useful transition metal salt is derived from ethylenediaminedisuccinate, and any complex of this ligand with iron or manganese can be used. One such catalytic system is described in assigned U.S. application Ser. No. 08/210,186, filed Mar. 17, 1994.

The bleach catalysts useful in machine dishwashing compositions and concentrated powder detergent compositions may also be selected as appropriate for the present invention. For examples of suitable bleach catalysts see U.S. Pat. No. 4,246,612 and U.S. Pat. No. 5,227,084.

See also U.S. Pat. No. 5,194,416 which teaches mononuclear manganese (IV) complexes such as Mn(IV) (1,4,7-trimethyl-1,4,7-triazacyclononane)-$(OCH_3)_3(PF_6)$.

Still another type of bleach catalyst, as disclosed in U.S. Pat. No. 5,114,606, is a water-soluble complex of manganese (II), (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand.

Other examples include Mn gluconate, $Mn(CF_3SO_3)_2$, $Co(NH_3)_5Cl$, and the binuclear Mn complexed with tetra-N-dentate and bi-N-dentate ligands, including $(N_4Mn(III)(\mu\text{-}O)_2Mn(IV)N_4)^+$ and $[Bipy_2Mn(III)(\mu\text{-}O)_2Mn(IV)bipy_2](ClO_4)_3$.

The bleach catalysts may also be prepared by combining a water-soluble ligand with a water-soluble transition metal salt such as one of manganese in aqueous media and concentrating the resulting mixture by evaporation. Any convenient water-soluble salt of the transition metal can be used herein provided that the metal is one known to react with hydrogen peroxide. The (II), (III), (IV) and/or (V) oxidation states may be used.

According to the invention sufficient manganese may be present in the wash liquor by including Mn proteinate in the compositions, however, to ensure its presence in catalytically-effective amounts the addition of a bleach catalyst mentioned above.

Other bleach catalysts are described, for example, in EP-A 408 131 (cobalt complex catalysts), EP-A 384 503, and EP-A 306 089 (metallo-porphyrin catalysts), U.S. Pat. No. 4,728,455 (manganese/multidentate ligand catalyst), U.S. Pat. No. 4,711,748 and EP-A 224 952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), DE 2,054,019 (cobalt chelant catalyst) CA 866,191 (transition metal-containing salts), U.S. Pat. No. 4,430,243 (chelants with manganese cations and non-catalytic metal cations), and U.S. Pat. No. 4,728,455 (manganese gluconate catalysts).

Bleach Catalysts, when used in the present invention, are preferably segregated from the hydrogen peroxide source, or from QSBA's, QSP's or diacyl peroxides. A convenient approach, which can have the additional advantage of conferring a protective effect upon enzymes as used herein, is to process the enzymes with a coating of transition metal bleach catalyst, optionally with a waxy nonionic surfactant.

In another mode, transition-metal containing bleach catalysts can be prepared in situ by the reaction of a transition-metal salt with a suitable chelating agent. For example, a mixture of manganese sulfate and EDDS (See Chelating Agent disclosure hereinafter).

When highly colored, transition metal-containing bleach catalysts may be coprocessed with zeolites, such as zeolite A or zeolite P, so as to reduce the color impact and improve the aesthetics of the product.

As a practical matter, and not by way of limitation, the compositions and processes herein can be adjusted to provide on the order of at least one part per ten million of the active bleach catalyst species in the aqueous washing medium, and will preferably provide from about 0.1 ppm to about 700 ppm, more preferably from about 1 ppm to about 500 ppm, of the catalyst species in the wash liquor.

In addition, the bleach system will generally contain a hydrogen peroxide source, as further defined hereinafter, whenever the bleach improving material or materials selected from the group consisting of:

i) organic peroxides, especially diacyl peroxides;

ii) quaternary substituted bleach activators;

iii) quaternary substituted peracids;

iv) transition-metal bleach catalysts;

v) peroxidase enzymes; and vi) mixtures thereof do not themselves contain a source of bleaching oxygen. That is, when the bleach improving material (b) comprises only component (ii), (iv) or (ii)+(iv), then a hydrogen peroxide source must be added to complete a minimum bleach system. On the other hand, when the bleach improving material is selected from components (i), (iii), (v), and mixtures thereof, it is not essential to add a hydrogen peroxide source.

In preferred embodiments of the invention, a hydrogen peroxide source is provided regardless of whether the bleach improving material provides bleaching oxygen. The hydrogen peroxide source is typically hydrogen peroxide itself, or a compound which delivers hydrogen peroxide on dissolution, such as is the case with sodium perborate monohydrate, sodium perborate tetrahydrate, sodium percarbonate, or mixtures thereof. Coated forms of these solid hydrogen peroxide sources can be used.

Preferred hydrogen peroxide sources include sodium perborate, commercially available, e.g., in the form of mono- or tetra-hydrate; urea peroxyhydrate, sodium percarbonate, and sodium peroxide. Particularly preferred are sodium perborate, sodium perborate monohydrate and sodium percarbonate. Percarbonate is especially preferred because of environmental issues associated with boron. Many geographies are forcing legislation to eliminate elements such as boron from formulations.

Highly preferred percarbonate can be in uncoated or coated form. The average particle size of uncoated percarbonate ranges from about 400 to about 1200 microns, most preferably from about 400 to about 600 microns. If coated percarbonate is used, the preferred coating materials include carbonate, sulphate, silicate, borosilicate, and mixtures thereof.

The mole ratio of hydrogen peroxide to bleach-improving material in the present invention preferably ranges from about 10:1 to about 1:1. Highly preferred ratios range from about 10:1 to about 3:1.

Optionally, conventional nonionic or anionic bleach activators having in common that they do not contain quaternary nitrogen (herein together with their corresponding peracids for convenience all collectively identified as "nonquaternary bleach activators"), such as TAED, NOBS (nonanoyloxybenzenesulfonate), benzoyl caprolactam, benzoyl valerolactam, or mixtures thereof can be added to the compositions. Other optional bleaching materials of this non-quaternary class include the heterocyclic peroxycarboxylic acids of U.S. Pat. No. 5,071,584; nonquaternary bleach activators and mixtures such as those of U.S. Pat. No. 5,269,962; surface-active peroxyacids such as those of U.S. Pat. No. 4,655,781; hydrophilic or hydrotropic peroxyacids such as those of U.S. Pat. No. 4,391,723; and older peroxybenzoic acid peracids or activator derivatives such as those of U.S. Pat. No. 3,075,921 or U.S. Pat. No. 2,955,905.

Protease enzymes are usually present in preferred embodiments of the invention at levels sufficient to provide from 0.005 to 0.1 Anson units (AU) of activity per gram of composition. The proteolytic enzyme can be of animal, vegetable or microorganism (preferred) origin. More preferred is serine proteolytic enzyme of bacterial origin. Purified or non purified forms of enzyme may be used. Proteolytic enzymes produced by chemically or genetically modified mutants are included by definition, as are close structural enzyme variants. Particularly preferred by way of proteolytic enzyme is bacterial serine proteolytic enzyme obtained from *Bacillus, Bacillus subtilis* and/or *Bacillus licheniformis*. Suitable commercial proteolytic enzymes include Alcalase™, Esperase™, Durazym™, Savinase™, Maxatase™, Maxacal™, and Maxapem™ 15 (protein engineered Maxacal); Purafect™ and subtilisin BPN and BPN' are also commercially available. Preferred proteolytic enzymes also encompass modified bacterial serine proteases, such as those described in EP-A 251 446 and which is called herein "Protease B", and in EP-A 199 404, Venegas, which refers to a modified bacterial serine proteolytic enzyme which is called "Protease A". More preferred is what is called herein "Protease C", which is a triple variant of an alkaline serine protease from *Bacillus* in which tyrosine replaced valine at position 104, serine replaced asparagine at position 123, and alanine replaced threonine at position 274. Protease C is described in WO 91/06637. Genetically modified variants, particularly of Protease C, are also included herein. Some preferred proteolytic enzymes are selected from the group consisting of Savinase™, Esperase™, Maxacal™, Purafect™, BPN', Protease A and Protease B, and mixtures thereof. Bacterial serine protease enzymes obtained from *Bacillus subtilis* and/or *Bacillus licheniformis* are preferred. An especially preferred protease herein referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76 in combination with one or more amino acid residue positions equivalent to those selected from the group consisting of +99, +101, +103, +107 and +123 in *Bacillus amyloliquefaciens subtilisin* as described in the U.S. patent applications of A. Baeck, C. K. Ghosh, P. P. Greycar, R. R. Bott and L. J. Wilson, entitled "Protease-Containing Cleaning Compositions" having U.S. Ser. No. 08/136,797, and "Bleaching Compositions Comprising Protease Enzymes" having U.S. Ser. No. 08/136,626.

The preferred compositions herein comprise a pH-adjusting component selected from water-soluble alkaline inorganic salts and water-soluble organic or inorganic builders. The pH-adjusting components are selected so that when the ADCC is dissolved in water at a concentration of 1,000-5,000 ppm, the pH remains in the range of above about 8, preferably from about 9 to about 12, particularly preferred from pH 10 to 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantites of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)-(vii).

Preferred embodiments contain low levels of silicate (i.e. from about 3% to about 8% $SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium bicarbonate.

The amount of the pH adjusting component in the instant ADCCs is preferably from about 1% to about 50%, by weight of the composition. In a preferred embodiment, the pH-adjusting component is present in the ADCC in an amount from about 5% to about 40%, preferably from about 10% to about 30%, by weight.

For compositions herein having a pH between about 9 and about 12 of the initial wash solution, particularly preferred ADCC embodiments comprise, by weight of ADCC, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, alkali metal, ammonium or substituted ammonium borates, hydroxysulfonates, polyacetates, and polycarboxylates. Preferred are the alkali metal, especially sodium, salts of such materials. Alternate water-soluble, nonphosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethyloxysuccinic acid, mellitic acid, and sodium benzene polycarboxylate salts.

When present, sodium and potassium, especially sodium, silicates are preferred. A particularly preferred alkali metal silicate is a granular hydrous sodium silicate having a $SiO_2$:$Na_2O$ ratio of about 2.0 or about 2.4 available from PQ Corporation, named Britesil H20 and Britesil H24. Most preferred is a granular hydrous sodium silicate having a SiO2:$Na_2O$ ratio of 2.0. While typical forms, i.e., powder and granular, of hydrous silicate particles are suitable, preferred silicate particles have a mean particle size between about 300 and about 900 μm with less than 40% smaller than 150 microns and less than 5% larger than 1700 μm. Particularly preferred is a silicate particle with a mean particle size between about 400 and about 700 μm with less than 20% smaller than 150 microns and less than 1% larger than 1700 μm.

Alternate silicate-containing materials which can be used in the pH-adjusting component or as builders include zeolites, such as zeolites A and P, including recently described assertedly "maximum aluminium" variants; or, more preferably, layer silicates such as SKS-6, a wide variety of such silicates are available from Hoechst Corp. or from PQ Corp. When used in the instant compositions for pH-adjusting, aluminium anticorrosion or surfactant-absorbing effects, the levels of any limited water-solubility silicates should not be such as to result in deposition on dishware.

ADC compositions of the present invention can comprise low foaming nonionic surfactants (LFNIs). LFNI can be present in amounts from 0 to about 10% by weight, preferably from about 0.25% to about 4%. LFNIs are most typically used in ADCCs on account of the improved water-sheeting action (especially from glass) which they confer to the ADCC product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxylates derived from primary alcohols, and blends thereof with more sophisticated surfactants, such as the polyoxypropylene/polyoxyethylene/polyoxypropylene reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 35° C., more preferably solid at about 25° C. For ease of manufacture, a preferred LFNI has a melting point between about 25° C. and about 60° C., more preferably between about 26.6° C. and 43.3° C.

In a preferred embodiment, the LFNI is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms (C16-C20 alcohol), preferably a C18 alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163.

Highly preferred ADCCs wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 80%, preferably from about 30% to about 70%, of the total LFNI.

Suitable block polyoxyethylene-polyoxypropylene polymeric compounds include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADCCs. Certain of the block polymer surfactant compounds designated PLURONIC™ and TETRONIC™ by the BASF-Wyandotte Corp., Wyandotte, Mich., are suitable in ADCCs of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADCCs are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available as SLF18 from Olin Corp., and any biodegradable LFNI having the melting point properties discussed hereinabove.

Preferred compositions of the present invention can optionally comprise limited quantities (up to about 2%) of nitrogen-containing nonionic surfactants, such as alkyldimethyl amineoxides or fatty glucosamides; when present, such surfactants normally require suds suppression e.g., by silicone suds suppressors.

Anionic Co-surfactant—The automatic dishwashing cleaning compositions herein are preferably substantially free from anionic co-surfactants. It has been discovered that certain anionic co-surfactants, particularly fatty carboxylic acids, can cause unsightly films on dishware. Moreover, may anionic surfactants are high foaming. Without intending to be limited by theory, it is believed that such anionic co-surfactants can interact with the quaternary substituted bleach activator and reduce its performance. If present, the anionic co-surfactant is typically of a type having good solubility in the presence of calcium. Such anionic co-surfactants are further illustrated by sulfobetaines, alkyl(polyethoxy)sulfates (AES), alkyl(polyethoxy)carboxylates, and short chained $C_6$-$C_{10}$ alkyl sulfates.

Silicone and Phosphate Ester Suds Suppressors—The ADCCs of the invention can optionally contain an alkyl phosphate ester suds suppressor, a silicone suds suppressor, or combinations thereof. Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADCC for use at 2000 ppm comprising 2% octadecyldimethylamine oxide may not require the presence of a suds suppressor. Indeed, it is an advantage of the present invention to select cleaning-effective amine oxides which are inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressor.

Phosphate esters have also been asserted to provide some protection of silver and silver-plated utensil surfaces; however, the instant compositions can have excellent silvercare without a phosphate ester component.

If it is desired nonetheless to use a phosphate ester, suitable compounds are disclosed in U.S. Pat. No. 3,314,891. Preferred alkyl phosphate esters contain from 16-20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the skilled person will generally choose to minimize the content of potentially depositing antifoams in the instant compositions.

Enzymes Other Protease (Including Enzyme Adjuncts)

Additional enzymes can be included in the formulations herein for a wide variety of substrate cleaning purposes, including removal of colored or triglyceride-based stains. Such enzymes include but are not limited to amylase(s), mannanase(s), carboxyhydrase(s), lipase(s), cellulase(s), pectinase(s) and peroxidase(s), as well as mixtures thereof. Other types of enzymes of any suitable origin, such as vegetable, animal, bacterial, fungal and yeast origin, may be added to further supplement the cleaning, stain-removing or anti-spotting action.

When present, lipases comprise from about 0.001 to about 0.01% of the instant compositions and are optionally combined with from about 1% to about 5% of a surfactant having limesoap-dispersing properties, such as an alkyldimethylamine N-oxide or a sulfobetaine. Suitable lipases for use herein include those of bacterial, animal and fungal origin, including those from chemically or genetically modified mutants. Suitable bacterial lipase include those produced by *Pseudomonas*, such as *Pseudomonas Stutzeri* ATCC 19.154 as disclosed in GB 1,372,034. Suitable lipases include those which provide a positive immunological cross-reaction with the anti body of the lipase produced from the micro-organism *Pseudomonas fluorescens* IAM 1057. This lipase and a method for its production have been described in JP 53-20487, Laid-Open Feb. 24, 1978. This lipase is available under the tradename Lipase P Amano, hereinafter "Amano-P". For additional lipase disclosures, see also U.S. Pat. No. 4,707,291, EP-B 0218272, EP-A 339,681, EP-A 385,401, and PCT/DK 88/00177.

When incorporating lipases into the instant compositions, their stability and effectiveness may in certain instances be enhanced by combining them with small amounts (e.g., less than 0.5% of the composition) of oily but non-hydrolyzing materials.

Peroxidase enzymes are also useful in the present invention. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in WO 89/099813.

Mannanase types usable in the present invention are those described in EP-A 1 007 617 in section "the mannanase enzyme" or any other type of protein comprising a mannanase activity.

All the mentioned enzymes individually can be included in amounts that 0.0001 wt % to 0.2 wt % of the according active protein is provided in one gram of the ADCC.

The enzyme-containing compositions, especially liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise for example calcium ion, boric acid, propylene glycol, short chain carboxylic acid, boronic acid, and mixtures thereof.

The stabilizing system of the ADCCs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are widely known and readily available, and are illustrated by salts containing ammonium cations or sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by several of the ingredients separately listed under better recognized functions, (e.g., other components of the invention such as sodium perborate), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other ingredients, if used. For example, formulation chemists generally recognize that combinations of reducing agents such as thiosulfate with strong oxidizers such as percarbonate are not wisely made unless the reducing agent is protected from the oxidizing agent in the solid-form ADC composition. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392.

The detergent compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetra-aminehexacetates, diethylenetriamine-pentaacetates, and ethanoldiglycines, iminodisuccinate, polyaspartic acid, methylglycindiaceticacid alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediamine-tetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233.

If utilized, these chelating agents or transition-metal selective sequestrants will generally comprise from about 0.01% to about 10%, more preferably from about 0.05% to about 1% by weight of the ADCCs of the invention.

Preferred compositions of the invention may additionally contain a dispersant polymer. When present, a dispersant polymer in the instant ADCCs is typically in the range from 0 to about 25%, preferably from about 0.5% to about 20%, more preferably from about 1% to about 8% by weight of the ADCC composition. Dispersant polymers are useful for improved filming performance of the present ADCCs, especially in higher pH embodiments, such as those in which wash pH exceeds about 9.5. Particularly preferred are polymers which inhibit the deposition of calcium carbonate or magnesium silicate on dishware.

Suitable dispersant polymers are illustrated by the film-forming polymers described in U.S. Pat. No. 4,379,080.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000, and most preferably is from about 1,000 to about 5,000.

Other suitable dispersant polymers include those disclosed in U.S. Pat. No. 3,308,067. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[($C(R^2)C(R^1)(C(O)OR^3)$)] wherein the apparently unfilled valencies are in fact occupied by hydrogen and at least one of the substituents $R^1$, $R^2$, or $R^3$; preferably $R^1$ or $R^2$ is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

The low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Agglomerated forms of the present invention may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in EP-A 66 915.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30 DEG C to about 100 DEG C, can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula:

$HO(CH_2CH_2O)_m(CH_2CH(CH_3)O)_n(CH(CH_3)CH_2O)_oOH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322; the dextrin esters of polycarboxylic acids disclosed in U.S. Pat. No. 3,929,107; the hydroxyalkyl starch ethers, starch esters, oxidized starches, dextrins and starch hydrolysates described in U.S. Pat. No. 3,803,285; the carboxylated starches described in U.S. Pat. No. 3,629,121; and the dextrin starches described in U.S. Pat. No. 4,141,841. Preferred cellulose-derived dispersant polymers are the carboxymethyl celluloses.

Yet another group of acceptable dispersants are the organic dispersant polymers, such as polyaspartate.

The present compositions further may contain one or more commonly known corrosion inhibitors or anti-tarnish aids. Such materials are preferred components of machine dishwashing compositions especially in European countries where the use of electroplated nickel silver and sterling silver is still comparatively common in domestic flatware, or when aluminium protection is a concern and the composition is low in silicate. When present, such protecting materials are preferably incorporated at low levels, e.g., from about 0.01% to about 5% of the ADCC. Suitable corrosion inhibitors include paraffin oil, typically a predominantly branched aliphatic hydrocarbon having a number of carbon atoms in the range of from about 20 to about 50; preferred paraffin oil is selected from predominantly branched C 25-45 species with a ratio of cyclic to noncyclic hydrocarbons of about 32:68. A paraffin oil meeting those characteristics is sold by Wintershall, Salzbergen, Germany, under the trade name WINOG 70.

Other corrosion inhibitor compounds include benzotriazole and comparable compounds; mercaptans or thiols including thionaphtol and thioanthranol; and finely divided Aluminium fatty acid salts, such as aluminium tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

Depending on whether a greater or lesser degree of compactness is required, filler materials can also be present in the instant ADCCs. These include sucrose, sucrose esters, sodium sulfate, potassium sulfate, etc., in amounts up to about 70%, preferably from 0% to about 40% of the ADCC. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Although optionally present in the instant compositions, the present invention encompasses embodiments which are substantially free from sodium chloride or potassium chloride and total chloride content may be further limited when using QSBA's or QSP's by use of alternative counter-anions to chloride, such as are illustrated by methosulfate or borate.

Hydrotrope materials such as sodium benzene sulfonate, sodium toluene sulfonate, sodium cumene sulfonate, etc., can be present in minor amounts.

The composition further can comprise lime soap dispersants and carry over tensides as described in the pending European patent application 03 022 032.1, filed Oct. 10, 2003

Bleach-stable perfumes (stable as to odor); and bleach-stable dyes such as those disclosed in U.S. Pat. No. 4,714,562 can also be added to the present compositions in appropriate amounts. Other common detergent ingredients consistent with the intention of the present invention are not excluded.

Since ADCC can contain water-sensitive ingredients or ingredients which can co-react when brought together in an aqueous environment, it is desirable to keep the free moisture content of the ADCCs at a minimum, e.g., 7% or less, preferably 4% or less of the ADCC; and to provide packaging which is substantially impermeable to water and carbon dioxide. Coating measures have been described to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

The present invention also encompasses a method for cleaning soiled tableware comprising contacting said tableware with an aqueous medium having an initial pH in a wash solution of above about 8, more preferably from about 9 to about 12, most preferably from about 10 to about 11, and comprising at least about 500 ppm of a cleaning composition comprising the manganese containing polymer as hereinbefore defined.

Some preferred substantially chlorine bleach-free granular automatic dishwashing compositions of the invention are as follows:

A substantially chlorine-bleach free automatic dishwashing composition comprising a bleach system comprising a source of hydrogen peroxide selected from sodium perborate and sodium percarbonate and a manganese proteinate.

A substantially chlorine-bleach free automatic dishwashing composition comprising a bleach system comprising a source of hydrogen peroxide selected from sodium perborate and sodium percarbonate and a manganese proteinate, optionally but preferably supplemented by a bleach activator selected from TAED and NOBS.

In a preferred embodiment of the invention the automatic dishwashing cleaning composition (ADCC) comprises manganese containing polymer in an amount of from 0.01 to 5 wt-%, preferably in an amount of 0.05 to 4 wt-%, particularly preferred in an amount of from 0.1 to 2 wt-%, based on the total amount of the composition.

The ADCC of the present invention can be provided in powder, granular or tablet form. If the ADCC is provided as a tablet it is preferred that the bleaching system and the manganese containing polymer are separated, e.g. they are contained in different layers or regions of the tablet. In case of granulated ADCC the ingredients of the bleaching system and the manganese containing polymer preferably are not in direct contact, particularly they are not cogranulated. Particularly preferred is that these ingredients are contained in different granules.

A further advantage of the use of the manganese proteinates in cleaning compositions according to the invention is that the manganese (compound) is stabilized by the protein moiety and can therefore be used in cleaning compositions without being modified, e.g. by coating with a waterproof layer, prior to its use.

The improved silver corrosion protection and silver cleaning properties of the inventive cleaning compositions containing low valent manganese proteinates can be seen from the following examples/tests.

Example 1

The manganese proteinate used in the example tests has the following product analysis: 6.4 wt.-% organic nitrogen, 6.8 wt.-% total nitrogen, 0.4 wt.-% ammonium nitrogen, 21 wt.-% organic carbon, 14 wt.-% manganese, 0.2 wt.-% calcium, 3.5 wt.-% sodium, 4.4 wt.-% chloride, 25.4 wt.-% sulfate.

The amino acid profile is (per 100 g total amount of amino acid): 9.0 g alanine, 6.3 g arginin, 5.6 g aspartic acid, 0.3 g cysteine, 10.4 glutamic acid, 25.0 g glycine, 8.2 g hydroxyproline, 1.2 g histidine, 1.5 g isoleucine, 3.5 g leucine, 4.4 g lysine, 0.8 g methionine, 2.3 g phenylalanine, 13.7 g proline, 1.7 g serine, 1.0 g threonine, 0.3 g tryptophane, 1.3 g tyrosine and 2.6 g valine.

Test 1: Silver Protection

In order to compare the performances of silver protection of cleaning compositions according to the prior art and to the present invention silver spoons were washed ten times in a dishwashing machine with cleaning compositions (A), (B) and (C). (A) is a dishwashing cleaning composition without "silver protection", (B) is the same dishwashing cleaning composition as (A) with an additional amount of 0.2% benzotriazole and (C) is the same dishwashing cleaning composition as (A) with an additional amount of 0.2% manganese proteinate according to the invention.

Automatic dishwashing cleaning composition (A) used in test 1:

| | |
|---|---|
| Sodium tripolyphosphate | 65% |
| Sodium percarbonate | 16% |
| Sodium carbonate | 6% |
| TAED | 3% |
| Sodium disilicate | 2% |
| Polycarboxylate | 2% |
| Protease | 2% |
| Polyethylene glycol | 2% |
| Nonionic surfactant | 1% |
| Amylase | 1% |

A normal cleaning program at the dishwashing machine was selected (Miele turbothermic plus, program "universal", or Bosch SKT5002, program "normal"; 55° C., water hardness 21° GH). Each time 15 g of a standard soil mixture (2.5% tomato ketchup, 2.5% mustard, 2.4% gravy powder, 0.5% potato starch, 0.1% benzoic acid, 6% egg yolk, 5% milk, 10% margarine and 71% water) was added in the cleaning cycle. The discoloration of the spoons is judged visually on a scale used by Institut Fresenius.

5=no discoloration (like new spoon); 4=minor discoloration; 3=slight discoloration; 2=strong discoloration; 1=very strong discoloration.

The results of the tests can be seen in FIG. 1. Cleaning composition (A) exhibits a discoloration score of 2, cleaning composition (B) exhibits a discoloration score of 3 and cleaning composition (C), according to the present invention, exhibits a discoloration score of 5.

Test 2: Cleaning Performance

The following soil compositions are prepared and used as described:

Corn Starch Soiling

Weigh 18 grams of cornstarch in 300 ml demiwater. Let this boil for 30 minutes under constant stirring. After the suspension has cooled to 50° C. put 1.5 grams on a porcelain dish and spread this homogeneously. Let the dish dry under room conditions for 1 hour and then for 4 hours at 80° C. The dish has to be weighted before and after the cleaning test, the amount cornstarch that will be washed of can be expressed in percent.

Black Tea Soiling

Boil 1 liter water of 16°GH (artificial prepared) and add 12 grams black tea. Let this extract for 5 minutes.

Put 60 ml of this tea in a cup and 10 ml on a dish and let it dry for 1 hour at 80° C. Then empty the cups and let the cups and the dishes dry for another 2 hours at 80° C. The dishes and cups have to be cooled down before the can be used in a cleaning test.

The cleaning result has to be judges visually where '1' is no cleaning and '10' is complete cleaning.

Milk Soiling

Add 10 ml milk in a 250 ml (high model) glass beaker. Place 6 filled beakers in a microwave for 10 minutes at 500 Watts. The beakers have to be cooled down before the can be used in a cleaning test.

The cleaning result has to be judges visually where '1' is no cleaning and '10' is complete cleaning.

Oatmeal Soiling

Add 25 grams of oatmeal to a mixture of 375 ml water and 125 ml milk and boil this under constant stirring for 10 minutes. Put 3.0 grams porridge on a porcelain dish and spread this homogeneously. Immerse spoons in the porridge.

Let the dishes and the spoons dry for 2 hours at 80° C. The dishes and spoons have to be cooled down before the can be used in a cleaning test. The cleaning result has to be judges visually where '1' is no cleaning and '10' is complete cleaning.

Minced Meat Soiling

Mix 150 grams minced meat, 50 grams egg and 40 grams of tab water with an electric hand mixer for a smooth mixture. Spread homogeneously 3.0 gram of this minced meat mixture on a porcelain plate and let it dry for 2 hours at 120° C. The dishes have to be cooled down before the can be used in a cleaning test.

The cleaning result has to be judged visually where '1' is no cleaning and '10' is complete cleaning.

Egg Yolk Soiling

Put 2 grams egg yolk on a stainless steel plate and spread this homogeneously. Let the stainless steel plate dry under room conditions for 4 to 24 hours. Immerse the dried plate for 60 seconds in boiling water. Dry the plate for 30 minutes at 100° C. The soiled plates have to be cooled down before they can be used in a cleaning test.

The plate has to be weighted before and after the cleaning test, the amount egg yolk that will be washed of can be expressed in percent.

Immerse forks in egg yolk and let them dry for 2 hours at 80° C. The forks have to be cooled down before the can be used in a cleaning test. The cleaning result has to be judges visually where '1' is no cleaning and '10' is complete cleaning.

Egg/Milk Soiling

Blend together 160 grams egg and 50 grams milk. Put 2 grams egg/milk mixture on a stainless steel plate and spread this homogeneously. Let the stainless steel plate dry under room circumstances for 4 to 24 hours. Immerse the dried plate for 60 seconds in boiling water. Dry the plate for 30 minutes at 100° C. The soiled plates have to be cooled down before they can be used in a cleaning test.

The plate has to be weighted before and after the cleaning test, the amount egg/milk soiling that will be washed of can be expressed in percent.

These soiled dishes are washed all together in an automatic dishwasher under the below listed conditions.

| | |
|---|---|
| Dishwasher: | Miele turbothermic plus |
| Waterhardness: | 21° GH |
| Programm: | universeel 55° C. |
| Dosage: | 20 grams of composition (B) or (C) |
| Soil mixture: | 50 grams |

Figure 2A:
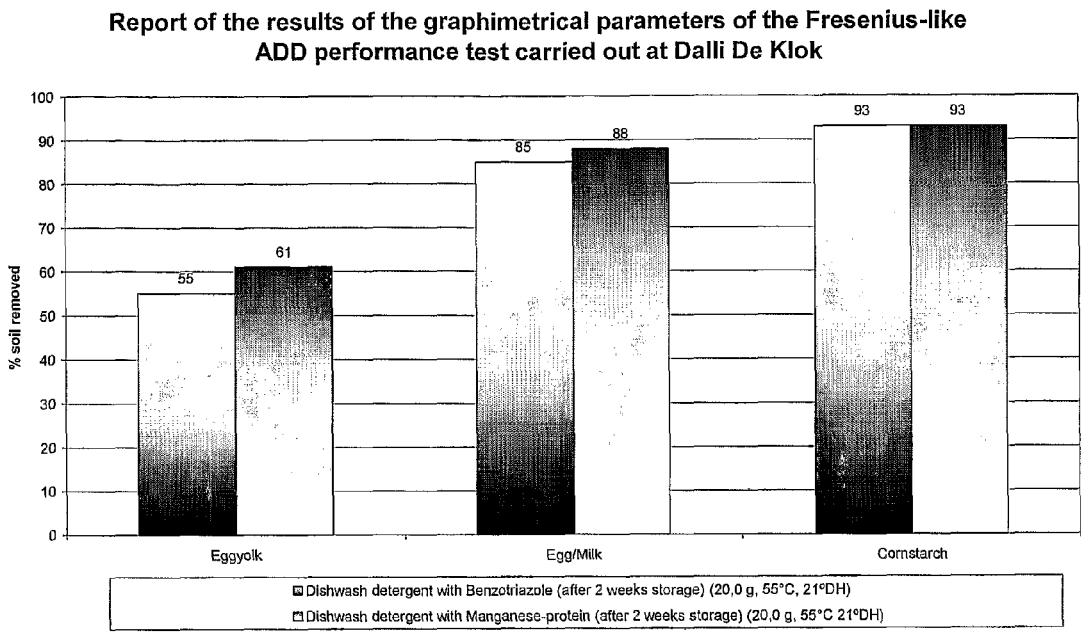
FIGS. 2 (A and B) shows the test results of Example 1, test 2 (cleaning performance). The graphical parameters of a dishwashing cleaning composition comprising benzotriazole according to the prior art and a dishwashing cleaning composition comprising manganese proteinate according to the present invention which resulted from a Fresenius-like ADCC performance test are shown and compared in FIGS. 2A and B.
Figure 2B:
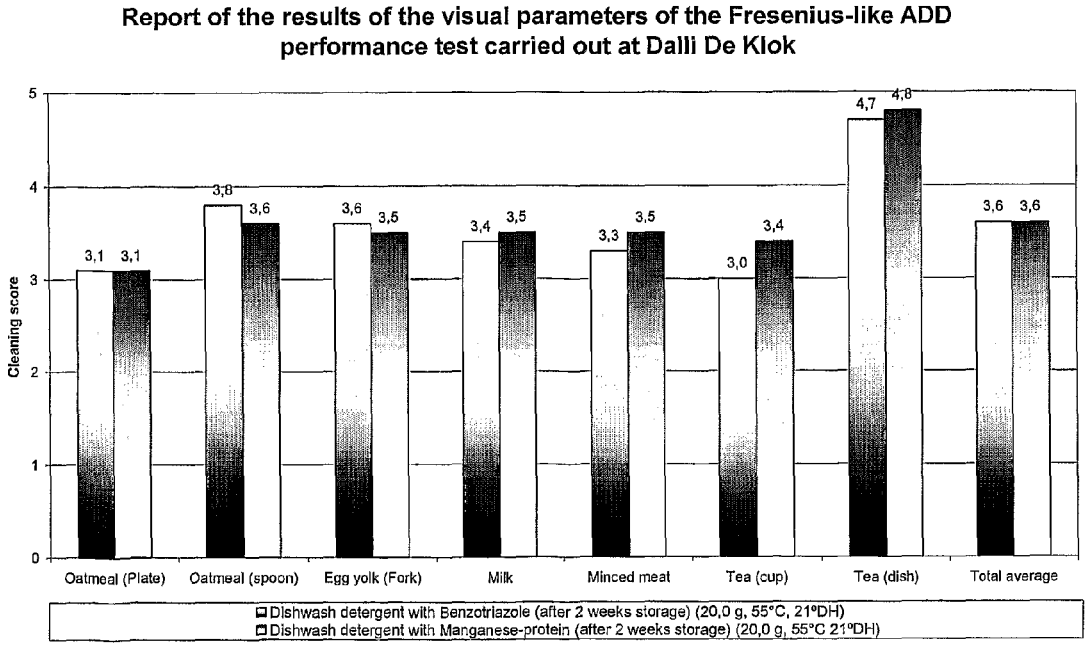

The graphical parameters of a dishwashing cleaning composition comprising benzotriazole according to the prior art and a dishwashing cleaning composition comprising manganese proteinate according to the present invention which resulted from a Fresenius-like ADCC performance test are shown and compared in FIGS. 2A and B.

As can be seen from the results, the soil removement with the dishwashing cleaning composition according to the present invention in comparison to a dishwashing composition containing benzotriazole (according to the state of the art imparting high cleaning performance) is comparable at a high level.

Test 3: Effect of Bleaching Performance:

To determine the effect of Manganese proteinate and $MnSO_4 \times 1$ aq. on the decrease of active oxygen a 1% solution was prepared with detergent (A) in water of 60° C. The active oxygen of the solution was measured several times during about one hour after the solution was made.

This experiment was also carried out with 0.3% and 2.5% $MnSO_4 \times 1$ aq. and with 0.6% and 5% manganese proteinate added to detergent (A). The manganese proteinate contains about 50% $MnSO_4 \cdot 1$ aq.

The results of the lower concentrations (0.3% $MnSO_4 \times 1$ aq., 0.6% manganese proteinate) of application are shown in FIG. 3.1-1 and the higher concentrations (2.5% $MnSO_4 \times 1$ aq., 5% manganese proteinate) of application are shown in FIG. 3.1-2. These results indicate that the decrease of the active oxygen is lowered when the manganese proteinate is used instead of $MnSO_4 \times 1$ aq, since the manganese "protected" by the polymer is less reactive with the oxygen, thus a higher oxygen concentration is maintained in the cleaning cycle.

Example 2

Further examples for automatic dishwashing cleaning compositions according to the present invention (all part in parts per weight)

| | composition | | | |
|---|---|---|---|---|
| ingredients: | 1 | 2 | 3 | 4 |
| Sodium tripolyphosphate | 35.00 | 45.00 | 18.00 | 59.00 |
| Sodium carbonate | 25.00 | 20.00 | 10.00 | — |
| Sodium dicarbonate | — | — | 10.00 | — |
| Silicate | 4.00 | 10.00 | 5.00 | — |
| Citrate | — | 5.00 | 10.00 | — |
| Sodium percarbonate or perborate | 15.00 | 8.00 | 20.00 | 20.00 |
| TAED | 4.00 | 5.00 | 2.00 | 2.00 |
| Lime soap dispersant (1) | 5 | 0.2 | — | 2 |

-continued

| ingredients: | composition 1 | 2 | 3 | 4 |
|---|---|---|---|---|
| Carry over Tensid (2) | 2.00 | 1.00 | 5.00 | 2.00 |
| nonionic Tenside | — | — | — | 2 |
| Phosphonate | 1.00 | 0.50 | 2.00 | — |
| Sulphonated Polycarboxylate (3) | 1 | 8 | 2 | 4 |
| Acrylate-Maleate Copolymer | 1.00 | — | 4.00 | 3.00 |
| Enzyme | 2.00 | 1.00 | 3.00 | 2.00 |
| Polyethylenglycol 1.500-10.000 | 2.00 | 3.00 | 1.00 | 2.00 |
| Manganese proteinate | 0.50 | 0.50 | 1.00 | 1.00 |
| Parfume | 0.50 | 0.05 | 2.00 | 1.00 |
| Sprengmittel | 3.50 | — | 7.00 | — |

(1) AMA 100 (Lakeland) (a dipropionate)
(2) Lutensol AT 25 (BASF) (nonionic Tenside C16/18 25 EO)
(3) Acusol 567D (Rohm & Haas)

The invention claimed is:

1. A machine dishwashing cleaning composition comprising a manganese proteinate, wherein a manganese ion, atom or compound is bound to a protein, protein fragment or a peptide, and wherein the cleaning composition is in the form of a tablet, a granulate or a powder.

2. The cleaning composition according to claim 1, wherein the protein cluster, protein or protein fragment is a random coil.

3. The cleaning composition according to claim 1, wherein the tablet form tabletted machine dishwashing cleaning composition additionally comprises contains a bleaching agent whereby the manganese proteinate compound and the bleaching agent are provided in separate layers of the tablet.

4. The cleaning composition according to claim 1, wherein the granulate form machine dishwashing cleaning composition further comprises a bleaching agent, wherein the bleaching a ent and the manganese proteinate are not cogranulated.

5. A method for silver protection from corrosion during cleaning, comprising cleaning a silver surface with a cleaning composition, according to claim 1.

6. A method for increasing bleaching performance of a cleaning composition comprising adding a manganese proteinate to said cleaning composition, wherein said manganese proteinate is a manganese ion, atom or compound bound to a protein, protein fragment or a peptide and wherein said cleaning composition is in the form of a tablet, a granulate or a powder.

* * * * *

UNITED STATES PATENT AND TRADEMARK OFFICE

CERTIFICATE OF CORRECTION

PATENT NO. : 7,754,672 B2
APPLICATION NO. : 10/591375
DATED : July 13, 2010
INVENTOR(S) : Beenen et al.

It is certified that error appears in the above-identified patent and that said Letters Patent is hereby corrected as shown below:

On the Title page, Item [75] (Third Inventor), please delete "Hardewijk (NL)" and insert therefore, --Harderwijk (NL)--.

At column 6, line 53 (approx), please delete "quantites" and insert therefore, --quantities--.

At column 12, line 8, please delete "tetraproprionates," and insert therefore, --tetrapropionates,--.

At column 13, line 54, please delete "molecular" and insert therefore, --molecular--.

At column 14, line 30, please delete "thionaphtol" and insert therefore, --thionaphthol--.

At column 14, line 64, please delete "2003" and insert therefore, --2003.--.

At column 19, line 9 (Table), please delete "Polyethylenglycol" and insert therefore, --Polyethyleneglycol--.

At column 19, line 11, please delete "Parfume" and insert therefore, --Perfume--.

At column 20, line 2, in Claim 2, after "the" please delete "protein cluster".

At column 20, line 5, in Claim 3, after "form" please delete "tabletted".

At column 20, line 6, in Claim 3, after "comprises" please delete "contains".

At column 20, line 7, in Claim 3, after "proteinate" please delete "compound".

At column 20, line 12, in Claim 4, please delete "a ent" and insert therefore, --agent--.

At column 20, line 15, in Claim 5, please delete "composition," and insert therefore, --composition--.

Signed and Sealed this
Twelfth Day of June, 2012

David J. Kappos

David J. Kappos
*Director of the United States Patent and Trademark Office*